US006644995B1

(12) United States Patent
Jones et al.

(10) Patent No.: US 6,644,995 B1
(45) Date of Patent: Nov. 11, 2003

(54) LOW INSERTION FORCE ELECTRICAL CONNECTOR

(75) Inventors: Dennis B. Jones, Orange City, CA (US); Rajagopalan Chandrasekhar, Huntington Beach, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/212,934

(22) Filed: Aug. 5, 2002

(51) Int. Cl.[7] ..... H01R 13/15
(52) U.S. Cl. ..... 439/260; 439/267
(58) Field of Search ..... 439/260, 263, 439/267, 635, 352–357

(56) References Cited

U.S. PATENT DOCUMENTS 3,329,926 A * 7/1967 Aksu et al. ..... 439/260 X
3,475,717 A * 10/1969 Lane ..... 439/260
4,553,803 A * 11/1985 Lapraik et al. ..... 439/260
4,613,193 A * 9/1986 Beers ..... 439/260 X
4,684,194 A * 8/1987 Jenkins et al. ..... 439/260
5,573,415 A * 11/1996 Fujitani et al. ..... 439/260
6,068,507 A * 5/2000 Popa ..... 439/489
6,368,129 B1 * 4/2002 Wang et al. ..... 439/260

* cited by examiner

*Primary Examiner*—Lynn Feild
*Assistant Examiner*—Son V. Nguyen
(74) *Attorney, Agent, or Firm*—Wei Te Chung

(57) ABSTRACT

An electrical connector (100) for insertion of a daughter printed circuit board (PCB) (200) includes an insulative housing (10), a number of terminals (20) received in the housing, and a sliding guide (30) movably retained in the insulative housing. The insulative housing defines a receiving slot (11) for receiving the sliding guide. Each terminal includes a contacting portion (22) for connecting with the daughter PCB. The daughter PCB is inserted into a receiving recess (34) defined in the sliding guide and pushes the sliding guide forwardly for driving the terminal to engage/disengage with the daughter PCB.

7 Claims, 4 Drawing Sheets

LOW INSERTION FORCE ELECTRICAL CONNECTOR

BACKGROUND OF THE INVENTION

1. Field of the Invention

The present invention relates to an electrical connector, and particular to a low insertion force electrical connector.

2. Description of Related Art

U.S. Pat. No. 4,514,030 discloses an edge card connector in FIGS. 4A–4C thereof having an insulative housing (10) and six pairs of opposite contacts (28, 30) retained in the insulative housing (10). The insulative housing (10) defines a slot (24) for receiving an inserted PCB (26) and six pairs of recesses (32, 34). Each of the terminals (28, 30) includes a free end portion (40), a projecting portion (42) and an outer end portion (36) connecting the free end portion (40) and the projecting portion (42). Each of the contacts (28, 30) is received in a corresponding recess (32, 34) with the free end portion (40) and the projection portion (42) projecting into the slot (24) for contacting with the inserted PCB (26).

However, if the contacts (28, 30) are made of materials with excellent rigidity, the insertion of the PCB (26) becomes difficult and the large mating force derived from excellent rigidity will damage contact pads on the inserted PCB (26). On the contrary, if the contact portions do not have good rigidity, after a period of use, the resiliency of the contacts (28, 30) will decrease so that the free end portion (40) and the projecting portion (42) cannot securely engage with the inserted PCB (26).

Hence, an electrical connector capable of providing reliable contact with an inserted PCB but will not damage the contact pads on the PCB is desired.

SUMMARY OF THE INVENTION

Accordingly, the object of the present invention is to provide an electrical connector having a movable sliding guide for actuating conductive terminals thereof to connect a printed circuit board inserted thereto in a low insertion force.

In order to achieve the object set forth, an electrical connector comprises an insulative housing, a sliding guide movably received in the housing, a plurality of terminals retained in the insulative housing, and a movable latching device assembled to the housing. The sliding guide defines a receiving recess in a center thereof for insertion of a daughter PCB, a plurality of receiving channels communicating with the receiving recess. Each of the terminals includes an inclined arm and a contacting portion at a free end of the inclined arm. When the daughter PCB is not fully inserted into the receiving recess, contact pads of the daughter PCB are not connected with the contacting portions. When the daughter PCB is fully inserted into the receiving recess, the daughter PCB pushes the sliding guide forwardly and the sliding guide presses against the inclined arms of the terminals so that the contacting portions move inwardly to electrically connect with the contact pads of the daughter PCB.

Other objects, advantages and novel features of the invention will become more apparent from the following detailed description of the preferred embodiment when taken in conjunction with the accompanying drawings.

DETAILED DESCRIPTION OF THE INVENTION

Figure 1:
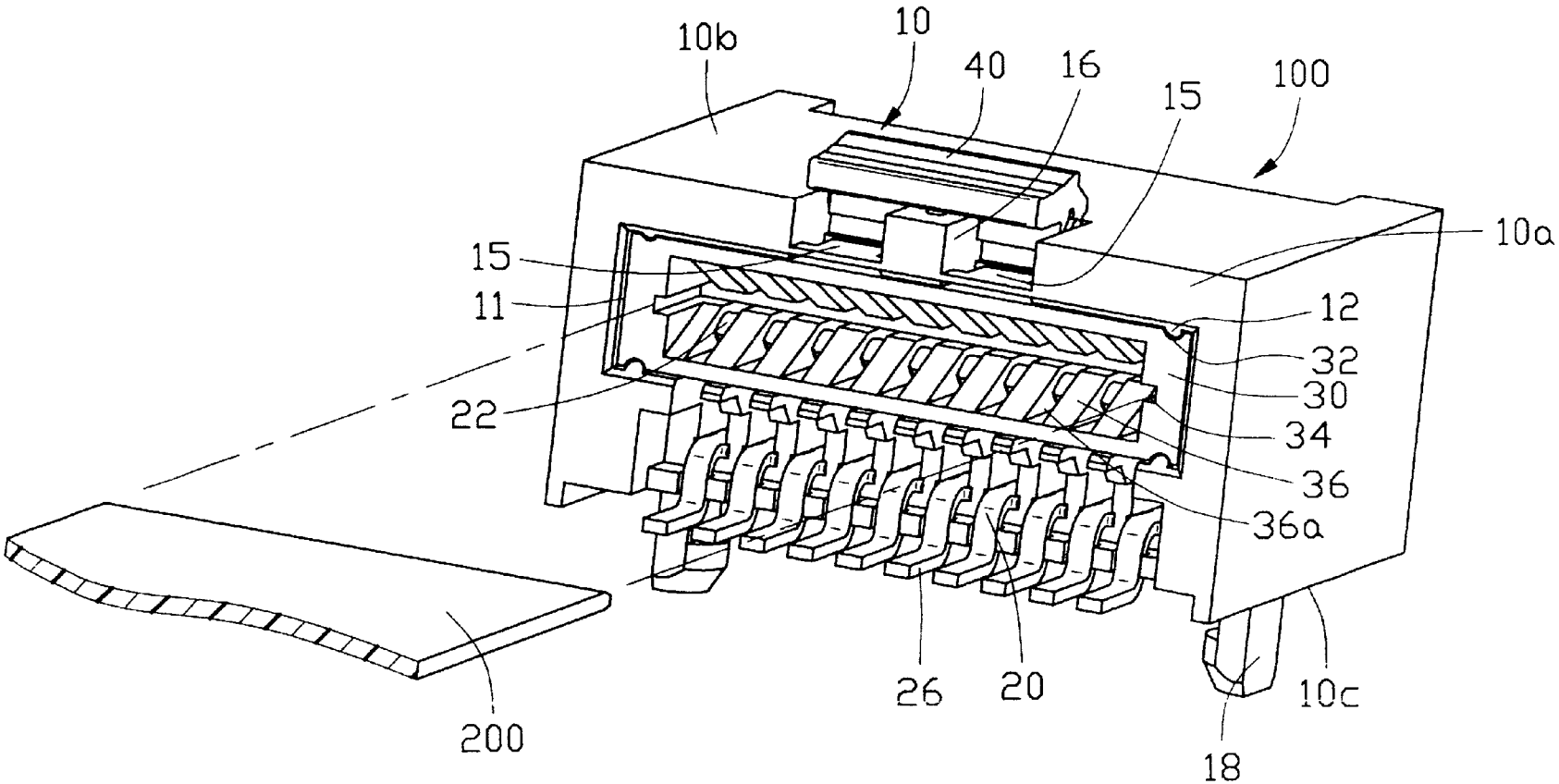
FIG. 1 is a perspective view of an electrical connector of the present invention and a daughter PCB.

Reference will now be made to the drawing figures to describe the present invention in detail.

Referring to FIG. 1, a low insertion force electrical connector 100 of the present invention mountable on a mother PCB (not shown) is provided for electrically engaging with an inserted daughter PCB 200 thereby establishing an electrical connection between the daughter PCB 200 and the mother PCB.

The electrical connector 100 includes a rectangular insulative housing 10, a plurality of upper and lower terminals 20 received in the insulative housing 10, a sliding guide 30 movably received in the insulative housing 10 and a latching device (not labeled) for control the movement of the sliding guide 30 in the housing 10.

The insulative housing 10 has a top surface 10*b*, a mating surface 10*a* perpendicular to the top surface 10*b* and a bottom mounting surface 10*c* parallel to the top surface 10*b*. The insulative housing 10 includes a rectangular receiving slot 11 at the mating surface 10*a* thereof, and two pairs of guiding ribs 12 protruding into the receiving slot 11 from an upper and a bottom peripheral walls of the receiving slot 11. In addition, the insulative housing 10 defines a pair of top recesses 15 at the top surface 10*b* thereof which are isolated from each other by a projection 16 thereof. Furthermore, a pair of posts 18 extends downwardly from the bottom mounting surface 10*c* for inserting into holes of the mother PCB to pre-retain the connector 100 onto the mother PCB. A position pillar 16*a* extends upwardly from the projection 16 for positioning a spring 17. It should be noted that the length of the position pillar 16*a* is shorter than the free length of the spring 17.

The sliding guide 30 includes a central receiving recess 34 and two pairs of semicircle guide slots 32 at an upper and a lower outer surfaces thereof for slidably receiving the respective guiding ribs 12. In addition, the sliding guide 30 forms a plurality of opposite upper and lower ribs 36. Every two adjacent upper or lower ribs 36 define a receiving channel 36*a*. Furthermore, a wedge 37 is formed at a front portion of the upper surface of the sliding guide 30.

Each of the terminals 20 includes a retaining portion 23 for securely retaining the terminal 20 in the insulative housing 10, an inclined arm 24 extending forwardly from a top end of the retaining portion 23, an arc contacting portion 22 at a free end of the inclined arm 24 and a horizontal soldering portion 26 extending from a bottom end of the retaining portion 23 out of insulative housing 10 for being soldered onto respective solder pads of the mother PCB (not labeled). The arc contacting portions 22 of the upper and lower terminals 20 extend closer to each other.

Figure 2A:
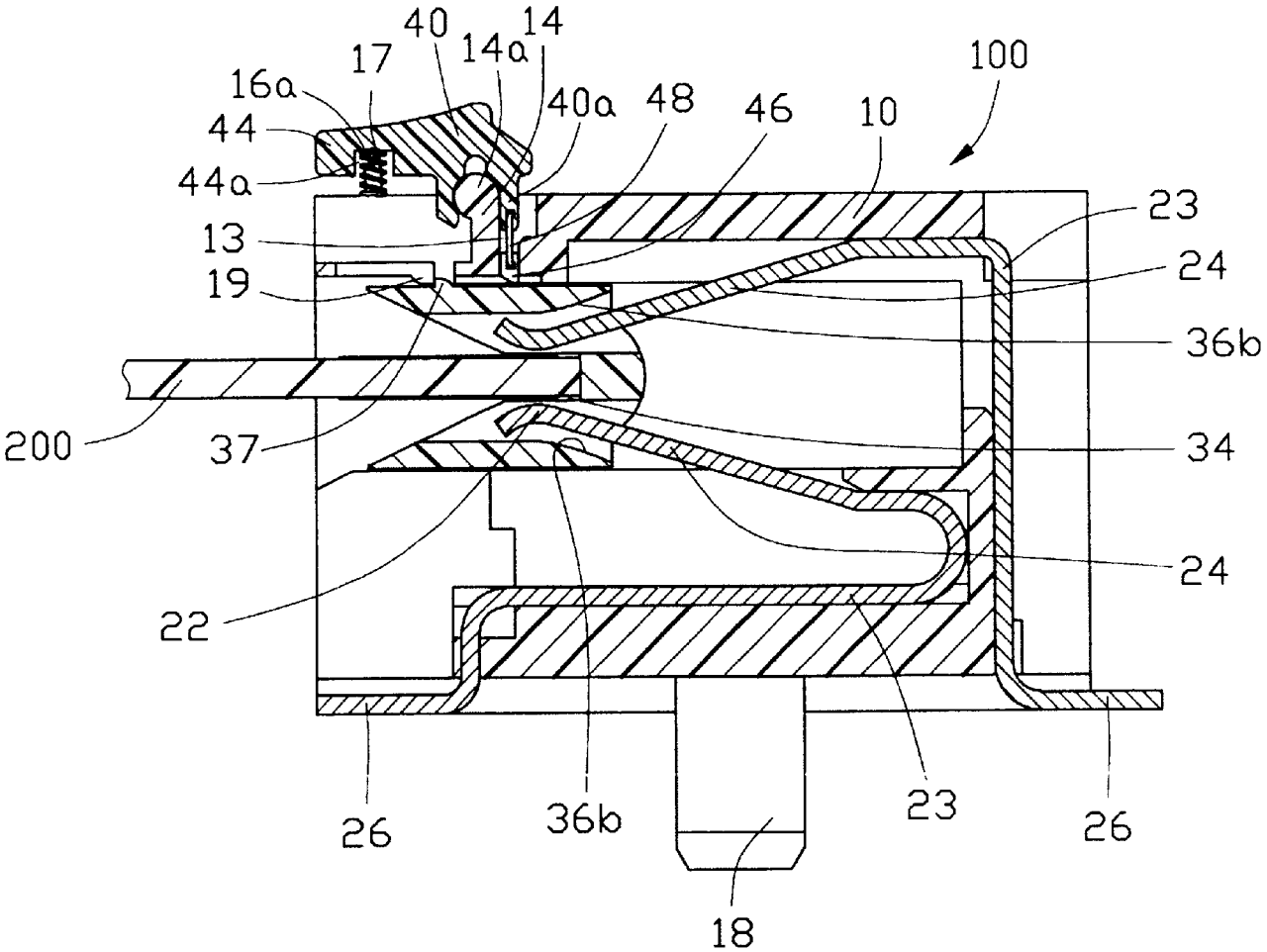
FIGS. 2A–2C are cross-sectional views of continuous inserting processes of the daughter PCB into the electrical connector.

Referring to FIG. 2A, the latching device includes a first stopper 19 integrally formed with the insulative housing 10 on a top surface of the receiving slot 11, a plastic snap latch 40 assembled to the top surface 10*b* of the insulative housing 10, a second stopper 46, a connecting member 48 connecting the plastic snap latch 40 with the second stopper 46, a pivot post 14 integrally formed with the insulative housing 10 and the locking wedge 37 formed at the upper outer surface of the sliding guide 30. The pivot post 14 has a semicircular header 14*a* at a top end thereof to which the plastic snap latch 40 is pivotably assembled. The plastic snap latch 40 includes a folk 40*a* extending downwardly from a front end thereof to connect the connecting member 48 and a handle 44 at a rear end thereof for manually operating the snap latch 40 to drive the second stopper 46 upwardly and downwardly thereby permitting or stopping the movement of the sliding guide 30. The handle 44 defines a recess 44*a* at a bottom face thereof for receiving the spring 17 and the position pillar 16*a*.

Figure 2B:
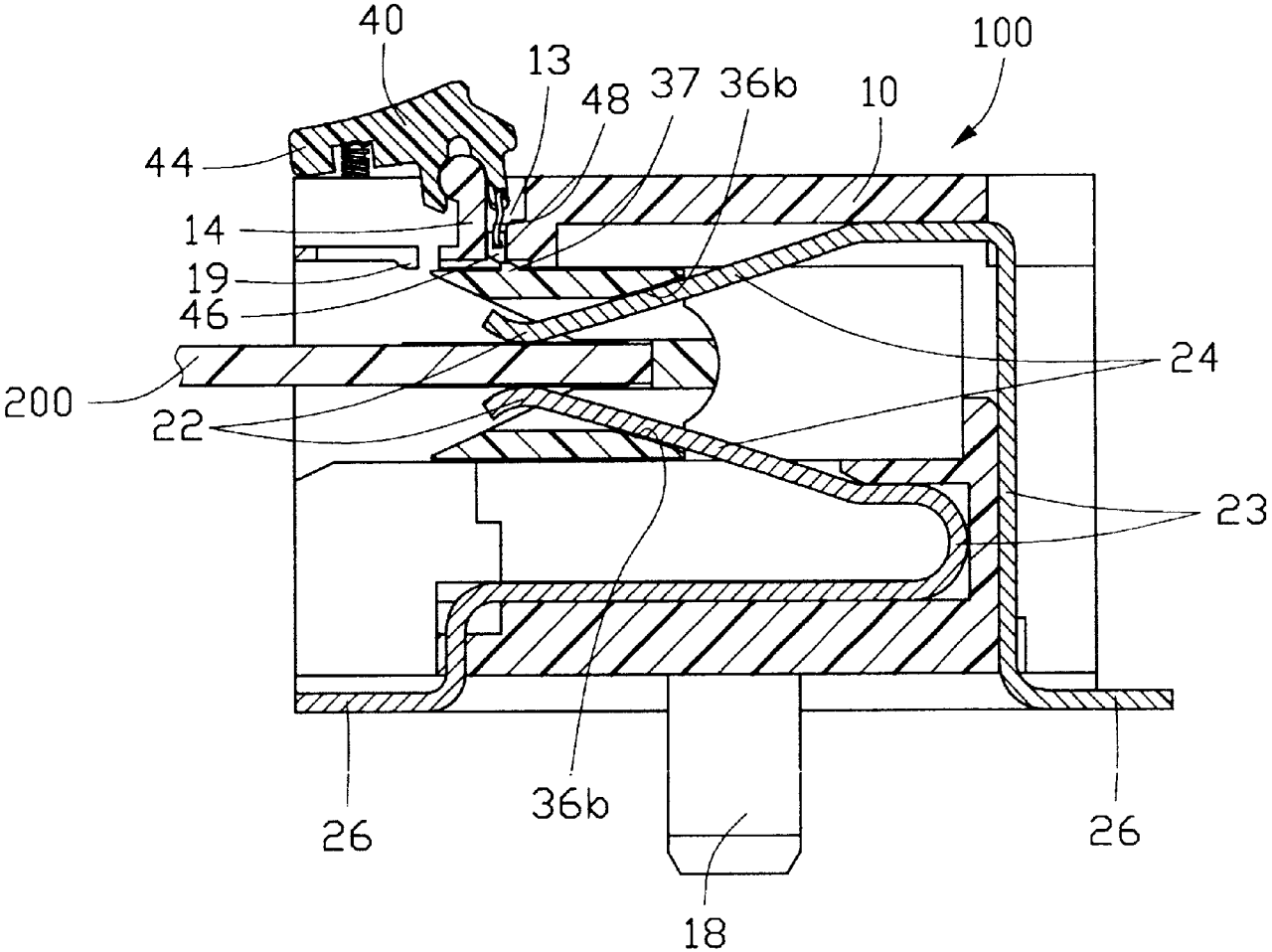
Figure 2C:
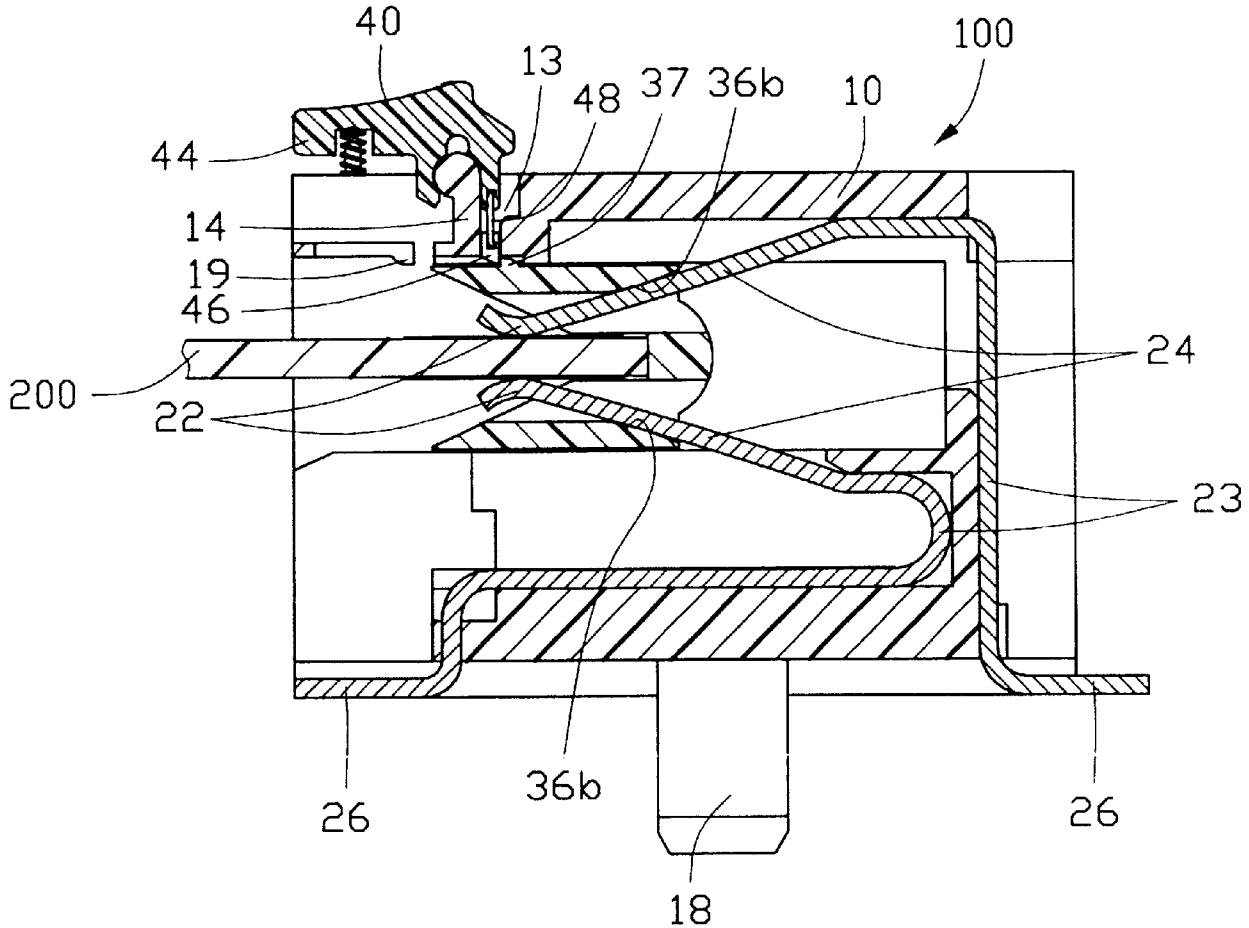

Referring to FIGS. 2A–2C, when the electrical connector 100 is at an open state, the wedge 37 is located between the first and second stopper 19, 46 and the arc contacting portions 22 of the upper and lower terminals 20 defines a first gap therebetween which is larger than the thickness of the daughter PCB 200. The first stopper 13 engages with the wedge 37 to prevent the sliding guide 30 from moving out of the receiving slot 11. The daughter PCB 200 is inserted into the receiving recess 34 of the sliding guide 30 with Zero Insertion Force (ZIF) and pushes the sliding guide 30 further into the insulative housing 10 until an inclined surfaces 36*b* of the slide guide 30 abut against the inclined arms 24 of the upper and lower terminals 20. When the sliding guide 30 is further pushed by the daughter PCB 200 into the insulative housing 10, the inclined surfaces 36*b* further force the inclined arms 24 to clamp the daughter PCB 200 until the wedge 37 passes through the second stopper 46. When the wedge 37 passes through the second stopper 46, the wedge 37 may force the second stopper 46 to move upwardly or the second stopper 46 is pulled by the connecting member 48 by pushing the handle 44. Successively, the second stopper 46 moves downwardly and engages with the wedge 37 so as to remain a secured electrical connection between the contacting portions 22 and the daughter PCB 200.

When the daughter PCB 200 is to be pulled out from the electrical connector 100, the handle 44 of the plastic snap latch 40 is pressed to lift the second stopper 46 to disengage with the wedge 37 of the sliding guide 30. The sliding guide 30 is pushed rearwardly because of a resilient force exerted by the inclined arms 24 of the terminals 20. The contacting portions 22 disengage with the daughter PCB 200 and the daughter PCB 200 can be pulled out by ZIF. Successively, the first stopper 19 engages with the wedge 37 and prevents the sliding guide 30 from moving out of the insulative housing 20.

In the present invention, a normal mating force between the daughter PCB 200 and the terminals 20 is produced from a downward movement of the contacting portion 22. Since the downward movement is controlled with the position/dimension of the wedge 37 and the second stopper 48, the normal mating force can be controlled. Thus, the wear between the contacting portions 22 and the daughter PCB 200 can be reduced for a controlled normal mating force.

It should be noted that in the present invention, the electrical connector 100 can also mate with a plug connector as well as the daughter PCB 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lower insertion force electrical connector, comprising:

an insulative housing defining a receiving slot at a mating surface thereof;

a plurality of terminals received in the housing, each terminal including a contacting portion for contacting with a complementary element;

a sliding guide movably retained in the receiving slot and defining a plurality of receiving channels for receiving corresponding contacting portions; and a latching device pivotally being assembled to the insulative housing and engaging with the sliding guide to locate the sliding guide at a fixed position in the insulative housing; wherein the sliding guide is pushed further into the receiving slot so that a front portion of the sliding guide drives the contacting portions of the terminals to move toward and electrically connect with the complementary elements; wherein the sliding guide comprises a wedge for engaging with the latching device; wherein the latching device further comprises a pivot post, a snap latch pivotably assembled to the pivot post and a second stopper assembled to the snap latch for engaging with the wedge and maintaining an electrical connection between the terminals and the complementary element.

2. The electrical connector as described in claim 1, wherein the latching device comprises a first stopper for engaging with the wedge for preventing the sliding guide from moving out of the insulative housing.

3. The electrical connector as described in claim 1, wherein the latching device further comprises a connecting member for connecting the second stopper with the snap latch.

4. The electrical connector as described in claim 1, wherein the sliding guide defines a central receiving recess for receiving the complementary element.

5. The electrical connector as described in claim 1, wherein the insulative housing forms a guiding post and the sliding guide defines a guide slot for receiving the guiding post.

6. An electrical connector assembly comprising:

an insulative housing defining a receiving slots;

two rows of terminals disposed in the housing by tow sides of the receiving slot;

a sliding guide moveably located in the receiving slot and defining a receiving recess located between two rows of the terminals;

a latch pivotally equipped to the housing and including a stopper, urged by a spring, to retain the sliding guide in a fixed position in the housing; and a printed circuit board inserted into the receiving recess and further into the receiving slot; wherein further forward movement of the printed circuit board actuates said sliding guide to forwardly move, thus resulting in portions of the sliding guide engage said two rows of terminals and deflecting said terminals inwardly to engage the printed circuit board so as to perform a low/zero insertion force during installation of the printed circuit board into the housing.

7. A method of assembling a printed circuit board into the card edge connector, comprising the steps of:

providing an insulative housing with a receiving slot;

disposing two rows of contacts by two sides of said slot;

providing a sliding guide with a receiving recess and abutment surfaces;

locating said sliding guide in the receiving slot and between two rows of contacts;

pivotally equipping the housing with a latch to lock said sliding guide in a fixed position in the housing, said latch defining a stopper retractably invading the receiving slot and a spring urging said stopper to be positioned in said receiving slot; and inserting the printed circuit board into the receiving recess to actuate said sliding guide to move forward; wherein forward movement of said sliding results in said abutment surfaces engaging the two rows of contacts to have the two rows of contacts inwardly deflected to each other and tightly sandwich the printed circuit board therebetween and the sliding guide engaging with the stopper of the movable latch to be retained in the fixed position.

* * * * *